US006422668B1

(12) United States Patent
Kelley et al.

(10) Patent No.: US 6,422,668 B1
(45) **Date of Patent: *Jul. 23, 2002**

(54) COMBINATION CREDENZA AND DESK

(75) Inventors: James O. Kelley, Spring Lake; Ralph Byma, Zeeland; Greg J. Persons, Wyoming, all of MI (US)

(73) Assignee: Sligh Furniture Co., Holland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/427,334

(22) Filed: Oct. 26, 1999

Related U.S. Application Data

(63) Continuation of application No. 09/067,791, filed on Apr. 28, 1998, now Pat. No. 5,971,504, which is a continuation of application No. 08/421,991, filed on Apr. 14, 1995, now Pat. No. 5,743,603.

(51) Int. Cl.[7] ..... A47B 17/04; A47B 17/06; A47B 17/03

(52) U.S. Cl. ..... 312/195; 312/194; 312/197; 312/200; 312/223.3; 312/249.7; 312/321.5; 248/188.4

(58) Field of Search ..... 312/195, 194, 312/197, 223.3, 249.1, 249.7, 249.9, 321.5, 239, 315, 351.11; 248/188.4

(56) References Cited

U.S. PATENT DOCUMENTS

| | | | | | |
|---|---|---|---|---|---|
| 260,703 | A | * | 4/1882 | Moore et al. | 312/200 |
| 330,409 | A | * | 11/1885 | Larson | 312/197 X |
| 369,590 | A | * | 9/1887 | Claypool | 312/197 X |
| 654,922 | A | * | 7/1900 | Schipkowsky | 312/197 X |
| 1,269,225 | A | * | 6/1918 | Scianamea | 312/197 |
| 5,536,080 | A | * | 7/1996 | Madimenos et al. | 312/197 X |
| 5,558,418 | A | * | 9/1996 | Lambright et al. | 312/321.5 |
| 5,584,546 | A | * | 12/1996 | Gurin et al. | 312/351.11 X |
| 5,632,540 | A | * | 5/1997 | Wilcox | 312/197 |
| 5,683,154 | A | * | 11/1997 | Chang | 312/194 |
| 5,743,603 | A | * | 4/1998 | Kelley et al. | 312/195 |
| 5,769,516 | A | * | 6/1998 | Aguilera | 312/321.5 |
| 5,820,238 | A | * | 10/1998 | Lambright | 312/321.5 |
| 5,927,833 | A | * | 7/1999 | Kelley | 312/223.3 X |
| 5,971,504 | A | * | 10/1999 | Kelley et al. | 312/195 |

* cited by examiner

*Primary Examiner*—Peter M. Cuomo
*Assistant Examiner*—Rodney B. White
(74) *Attorney, Agent, or Firm*—Waters & Morse, P.C.

(57) ABSTRACT

A furniture unit comprises a closed-front credenza that folds out to form an L-shaped desk. The unit comprises a stationary desk having a partially open front, with a kneehole opening forming at least a portion of the open front. A moveable return pivotally mounted at on one side of the desk comprises a vertical face panel and a work surface mounted at a rear side of the face panel. The return is pivotal between a closed position, wherein the face panel covers the open portion of the front of the desk and the return work surface is concealed behind the face panel, and an open position, wherein the face panel is pivoted outward from the front of the desk, exposing the kneehole opening in the desk. The return work surface extends forward from the desk alongside the kneehole opening when the return is opened. The face panel is configured so as to create the impression that the furniture unit is a credenza with no kneehole opening when the return is closed. A column of functional drawers is mounted in the desk at the side opposite from the moveable return, with the face panel extending across the front of the desk to the drawers when the return is closed. The unit has a legless support mechanism for an inner corner of the return work surface that eliminates the need of a movement obstructing support leg at the corner. The unit also has lockable and vertically adjustable casters. A keyboard tray and inner storage unit are spaced below the desk top so that the return work surface fits under the desk top when the return is closed. The base molding is formed to conceal the fact that the return opens.

13 Claims, 4 Drawing Sheets

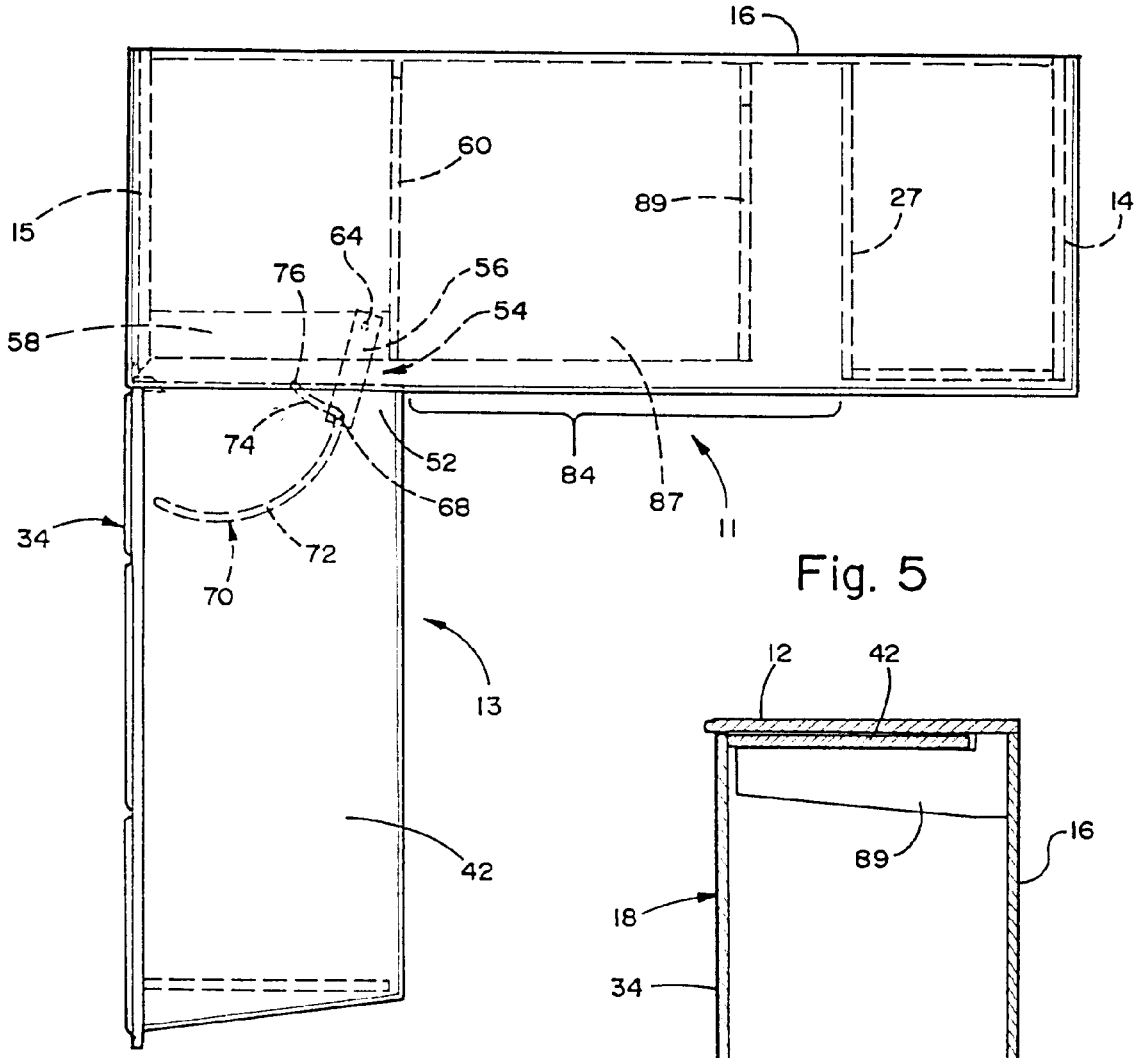
Fig. 5
Fig. 7
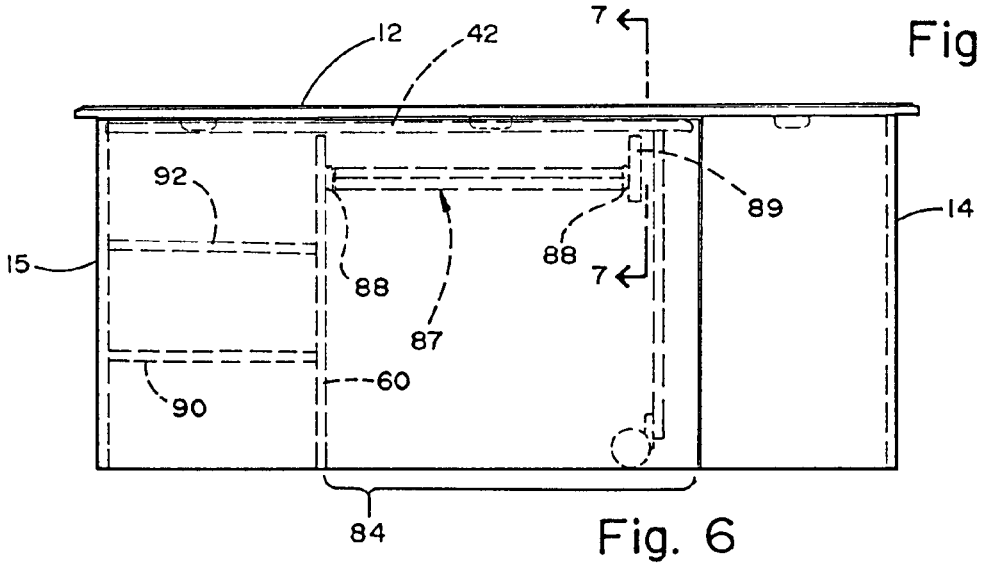
Fig. 6

COMBINATION CREDENZA AND DESK

CROSS-REFERENCES TO RELATED APPLICATIONS

This is a continuing application of co-pending U.S. patent application Ser. No. 09/067,791, now U.S. Pat. No. 5,971,504 entitled Combination Credenza and Desk and filed on Apr. 28, 1998, by J. Kelley et alia, the disclosure of which is incorporated here by reference, which is a continuing application of co-pending U.S. patent application Ser. No. 08/421,991, now U.S. Pat. No. 5,743,603 entitled Combination Credenza and Desk and filed on Apr. 14, 1995, by J. Kelley et alia, the disclosure of which is incorporated here by reference.

STATEMENT REGARDING FEDERALLY SPONSORED RESEARCH OR DEVELOPMENT

Not Applicable.

BACKGROUND OF THE INVENTION

The invention relates to a furniture unit wherein the front panel of a credenza pivots outward to form an L-shaped desk.

There are many applications where it is desirable to have a fully functioning desk located for convenient use but where a desk would be obtrusive or inconsistent with other decor when the desk is not in use. With the advent of the computer age, the desirability of a desk for a computer in the home has increased. Desks for computer applications frequently include pull out keyboard trays, shelves for printers, and other functional conveniences. Most conventional computer desks have a very functional, office-like appearance that is not completely compatible with home furnishing of the type found in a living room or the like. An object of the present invention is to provide a combination furniture unit that has the appearance and much of the function of a conventional credenza but which is convertible into a fully functioning L-shaped desk.

BRIEF SUMMARY OF THE INVENTION

In accordance with the present invention, a furniture unit providing a combination credenza and desk comprises a stationary desk having a desk top supported on side panels, the desk having at least a partially open front, with a kneehole opening forming at least a portion of the open front. A moveable return is pivotally mounted at the front of the desk to one side of the kneehole opening, the return comprising a vertical face panel and a work surface mounted at a rear side of the face panel. The return is pivotal between a closed position, wherein the face panel covers the open front of the desk and the return work surface is concealed behind the face panel, and an open position, wherein the face panel is pivoted outward from the front of the desk, exposing the kneehole opening in the desk. The return is mounted such that the return work surface extends forward from the desk alongside the kneehole opening when the return is opened, the face panel being configured so as to create the impression that the furniture unit is a credenza with no kneehole opening when the return is closed.

In one aspect of the invention, the desk includes a column of exposed storage locations adjacent a side of the desk opposite from the side on which the return is pivotally mounted, the kneehole opening being adjacent to the exposed storage locations, the front panel extending across the kneehole opening and up to the exposed storage locations when the return is closed.

Preferably, the exposed storage locations comprise drawers having drawer fronts, and the face panel has a facade that has the appearance of at least of one or more of drawer fronts or doors leading to internal storage locations, such that the front of the desk belies the presence of a desk having a kneehole opening when the face panel is closed. Desirably, the face panel facade extends from a first side edge of the desk to the exposed storage locations and comprises a plurality of simulated drawer fronts adjacent the first side where the face panel is pivotally attached to the desk.

The work surface on the return extends outward from the rear side of the face panel at a position below the level of the desk top, the desk having an opening below the desk top such that the return work surface fits inside the desk below the desk top when the return is closed. An inner drawer unit and keyboard tray are recessed below the desk top to permit the return work surface to fit under the desk top.

Another feature of the invention is a legless support mechanism that supports an inner corner of the return work surface in such a way that an operator has unobstructed freedom of knee movement to swivel between the desk top work surface and the return work surface when seated at the desk. A pivoting support plate having a pin that rides in a groove in the underside of the return work surface provides this support. Other features of the invention include lockable and vertically adjustable casters and a base molding that conceals the fact that the return opens from the credenza.

These and other features, objects, and benefits of the invention will be recognized by one having ordinary skill in the art and by those who practice the invention, from the specification, the claims, and the drawing figures.

BRIEF DESCRIPTION OF THE SEVERAL VIEWS OF THE DRAWING

FIG. 5 is a plan view showing the L-shaped return fully extended from the credenza.

FIG. 6 is a front elevational view of the present invention with the face panel and drawer units removed for clarity of illustration.

FIG. 7 is a sectional view taken along line 7—7 of FIG. 6.

DETAILED DESCRIPTION OF THE INVENTION

Figure 2:
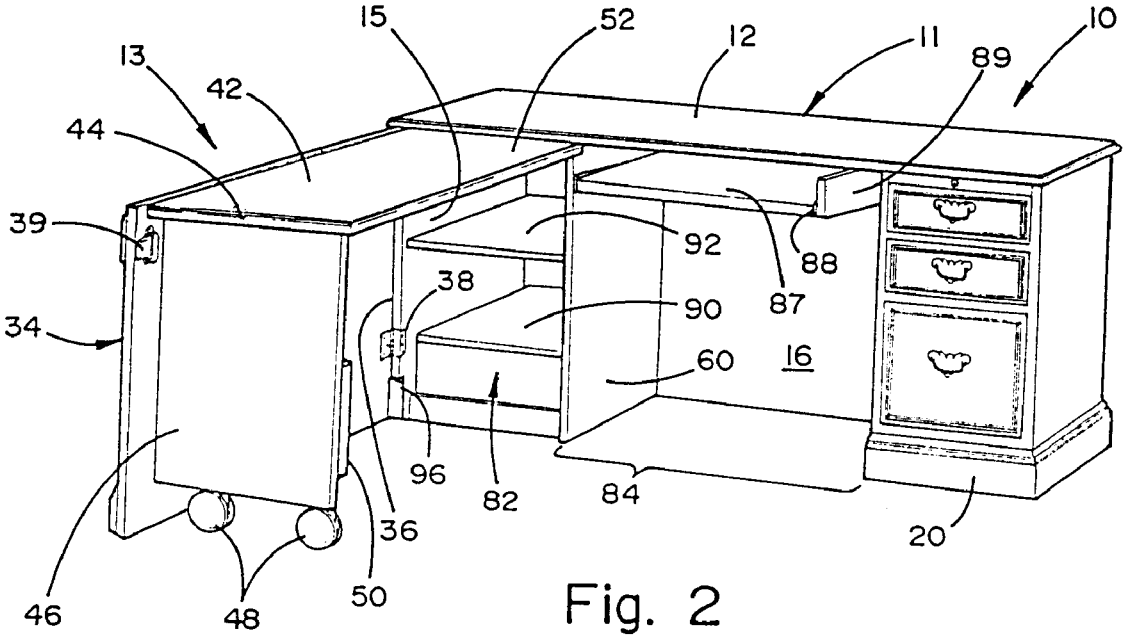
FIG. 2 is a perspective view of the present invention converted into an L-shaped desk.
Figure 1:
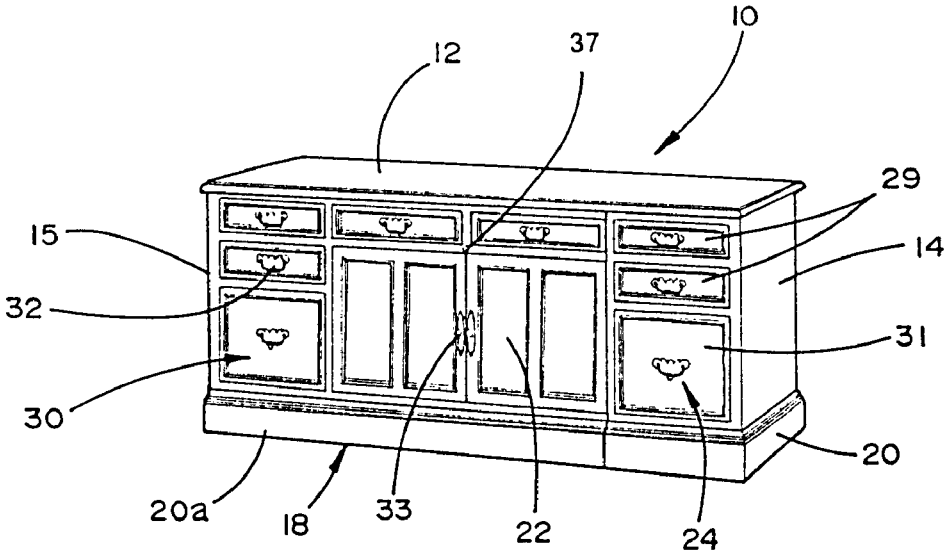
FIG. 1 is a perspective view of the combination desk and credenza of the present invention in the configuration of a credenza.

Referring to the drawings, a furniture unit containing a credenza and desk 10 of the present invention is shown in FIG. 1 in the configuration where the unit serves as a credenza. In FIG. 2 the unit is transformed into a stationary desk 11 and L-shaped return 13 by pivotally moving the return outward from the desk.

The credenza has a top 12 (which serves as the desk top), side panels 14 and 15, a rear panel 16, and a front 18, with the panels extending from the top downward to the floor, with a baseboard or base molding 20 extending outward from the bottom of each panel.

Front 18 is in part functional and is in part a facade. As shown in FIG. 1, the front of the credenza has the appearance of three separate sections, a right hand section 24 comprising a column of storage locations including file drawer 31 positioned below a pair of box drawers 29, a central section 22 having the appearance of a pair of drawers positioned over hinged doors, and a left hand section 30 having a similar or at least a complementary appearance to the appearance of the drawer front facade of right section 24.

Right section 24 comprises functional box drawers 29 and a file drawer 31. The center and left sections 22 and 30 simulate drawer and door fronts but are a decorative facade on a movable face panel 34, complete with drawer handles 32 and door handles 33. A functional lock 37 of conventional design operates a slide latch 38 (see FIG. 2) that latches moveable face panel 34 in a closed position as shown in FIG. 1.

Referring to FIG. 2, moveable face panel 34 is hinged at an inner edge 36 by means of hinges 38 to a forward edge of the left side panel 15.

A return work surface 42 is mounted at a back edge to the back side of face panel 34. An outer edge 44 of work surface 42 is tapered slightly in order to facilitate the opening and closing of the moveable panel. An end panel 46 extends downward from a position adjacent an outer end of work surface 42, and a pair of dual wheel casters 48 support the lower edge of panel 46 on the floor.

These casters are both lockable and adjustable to adjust the vertical height of the work surface and moveable panel. The position of work surface 42 is slightly below the position of top (sometimes called desk top) 12, so that when moveable panel 34 is folded inwardly, work surface 42 slides under top 12. A magazine storage rack 50 is mounted on the inner surface of panel 46.

Figure 3:
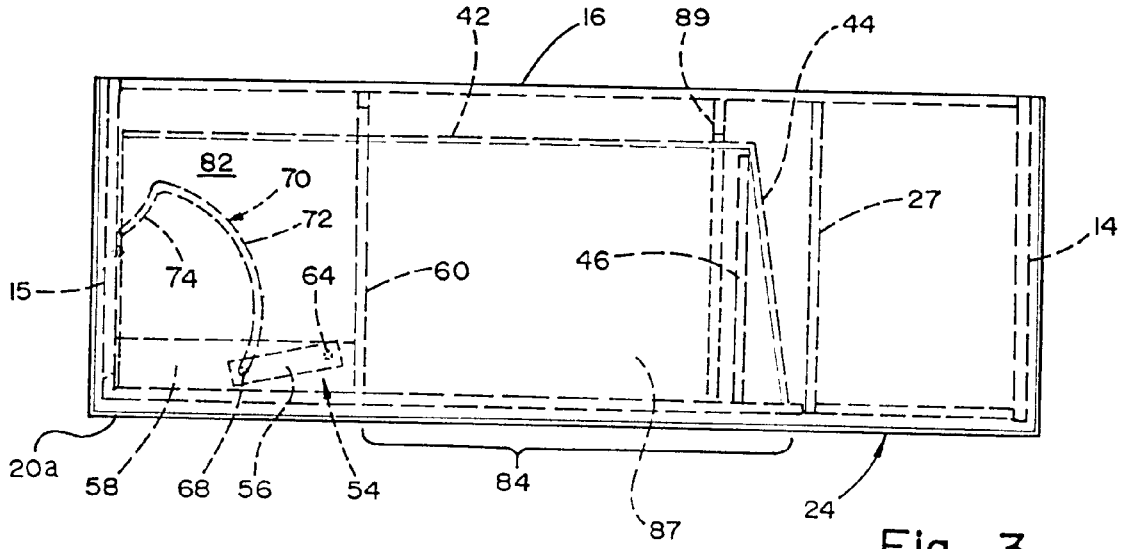
FIG. 3 is a plan view showing the L-shaped return folded into the desk in a closed position.
Figure 4:
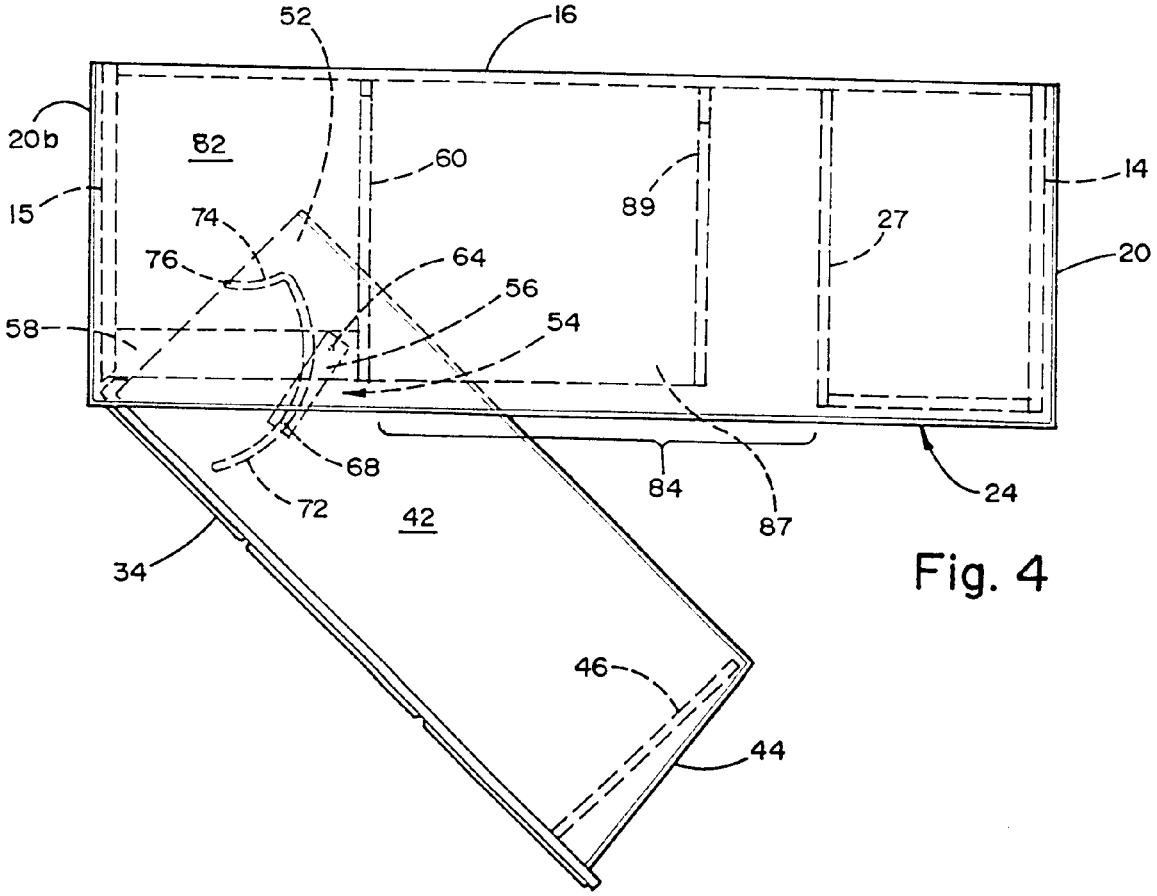
FIG. 4 is a plan view showing the L-shaped return in the process of being pivoted outward from the credenza.

The inner corner 52 of work surface 42 is mounted to the stationary desk portion 11 of the unit for supported pivotal movement by means of a legless support mechanism 54 shown in FIGS. 3–5. Support mechanism 54 comprises a pivot support plate 56 (which desirably is a rigid metal plate) pivotally mounted on a spanner or beam 58 that extends between an inner panel 60 and outer panel 15 of the stationary desk unit and positioned adjacent the underside of work surface 42.

Pivot support plate 56 is mounted on a pivot fastener 64 that extends through an end of the pivot support plate and spanner 58 into a nut. Preferably the fastener is a screw or bolt having a beveled head that fits in a recessed conical opening in the top of the support plate so as to be flush with the top of the support plate. A spacer can be provided between the support plate 56 and the spanner in order to hold the support plate above the surface of spanner 58, so that the support plate does not rub against the upper surface of the spanner as it pivots.

The outer end of pivot support plate 56 has an upstanding pin 68 thereon. This pin rides in a groove 70 in the underside of work surface 42. This groove has an arcuate outer section 72 that the pin rides in as the work surface is pivoted inward and outward. (See FIGS. 3–5) Pivot support plate pivots about pivot fastener 64 as the work surface 42 is pivoted inward and outward. Groove 70 has an inner section 74 that extends from an inner end of arcuate section 72 to the inner end of work surface 42. The support plate pin is rotated into an open inner end 76 of groove 74 for initial installation of the unit during assembly of the top and the base of the unit. Thereafter, pin 68 rides in groove outer section 72 for opening and closing the desk unit.

When the moveable return 13 is closed into the stationary desk 11, top 42 fits under the top 12 of the desk and over inner panel 60, which is adjacent an open kneehole portion 84 of the desk unit. The top of panel 60 and an adjacent inner storage unit 82, which extends between panels 15 and 60, are spaced downward from top 12 sufficiently that top 42 fits and slides freely between the upper edge of panel 60 and the top of inner storage unit 82 and the underside of top 12.

As top 42 pivots inwardly, it also fits over the top of keyboard tray 87, which is spaced away from the underside of top 12 and mounted on retracting support hardware 88 attached to panel 60 and a cantilever bracket 89. The cantilever support bracket has a recessed upper surface at the front of the desk that is spaced below top 12 sufficiently that work surface 42 can fit over the keyboard tray and bracket when the return is closed (see FIGS. 6 and 7).

When the return is pivoted outward to the position shown in FIG. 2, separate open faced storage compartments that form inner storage unit 82 are exposed on the left hand side of the kneehole portion 84 of the desk. These storage units comprise a lower shelf 90 for a printer and an upper shelf 92 for storing other materials. The printer shelf can be mounted on a drawer glide unit for extending and retracting the printer shelf.

Figure 10:
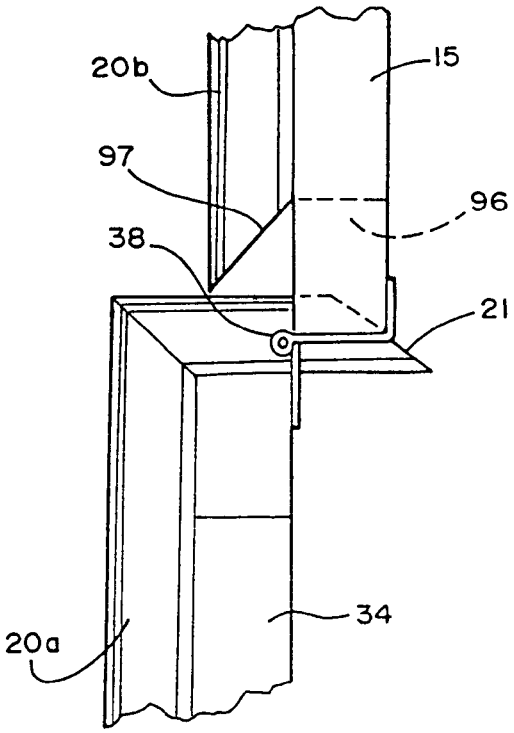
FIGS. 8–10 are fragmentary sectional plan views showing the baseboard construction at the corner of the desk where the return is hinged, the figures showing the closed, partially open and completely open positions of the return, respectively.
Figure 9:
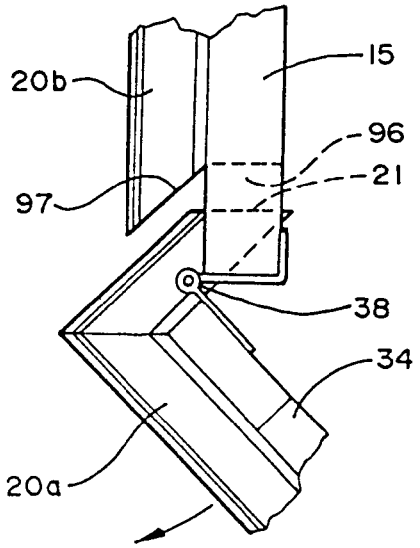
Figure 8:
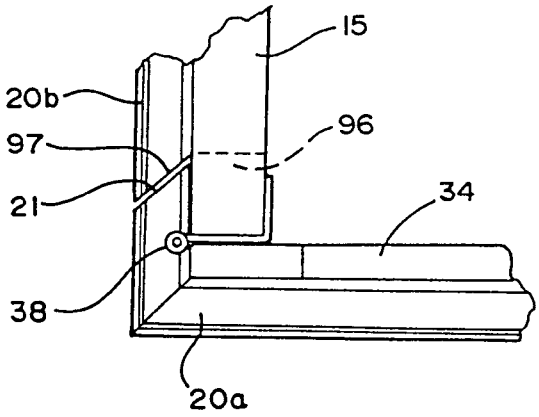

As shown in FIGS. 1 and 2, the base of the unit includes an outward extending baseboard molding 20. The manner in which the appearance of a continuous base board molding is maintained at the left front hinge corner of the unit is shown in FIGS. 8–10. The baseboard portion 20*a* of face panel 34 extends to the corner and around the corner to a beveled end 21 a short distance adjacent the hinge 38. Side panel 15 immediately below the hinge is recessed rearward to form a recessed portion 96. The forward edge 97 of the base board molding 20*b* on the left hand side of the desk is beveled sufficiently that the adjacent edge 21 of the base board molding 20*a* attached to the moveable panel will pivot past edge 97 and fit into the recessed portion 96 below hinge 38. With this construction, when the moveable panel is closed, the base board molding has the appearance of a substantially continuous element, with the beveled surface 97 on baseboard 20*b* on the side of the furniture unit mating with surface 21 and concealing the fact that the front panel pivots open with respect to the remainder of the unit.

Figure 11:
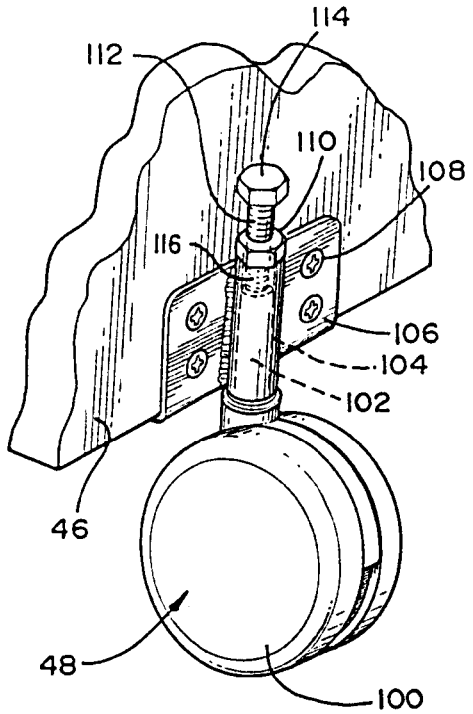
FIG. 11 is a fragmentary perspective view showing the adjustable caster of the present invention.

The manner in which the casters are adjustable is shown in FIG. 11. Each caster 48 comprises a wheel 100 (single or double) mounted on a stem 102. The stem fits in a socket 104 in a housing or caster bracket 106 mounted by screws 108 on the side of panel 46. An L-shaped portion of the bracket fits under the panel. A nut 110 is mounted on the top of the socket or stem housing. A bolt 112 with a hex head 114 is threaded into nut 110 and extends into the stem housing. The lower end 116 of the bolt engages the stem and acts as a stop for the stem. Rotation of the bolt 112 changes the vertical position of the stem 102 and caster 48 with respect to panel 46. By adjusting bolt 112, the stem 102 of caster 48 can be raised or lowered in order to maintain the proper elevation of the end panel 46.

In operation, the present invention serves as a credenza when folded into the configuration shown in FIG. 1. When it is desired to access the desk, lock 37 is released and the return 13 is pulled outward to the position shown in FIG. 2. Collapse of the desk unit is performed by reversing this procedure.

It should be understood that the foregoing is merely representative of a preferred embodiment of the present invention and that various changes and modifications may be made in the arrangements and details of construction of the embodiments disclosed herein without departing from the spirit and scope of the present invention, which is defined in the appended claims.

What is claimed is:

1. A furniture unit providing a combination credenza and desk, comprising:

a stationary desk, the desk having a front, an opposing back, and two opposing ends, the desk having a desk top, the desk having first and second side panels that extend generally downward from the desk top toward a supporting floor, the first and second side panels being spaced apart from one another, whereby a kneehole opening is defined between the first and second side panels;

a moveable return, the return having opposing inner and outer ends, the inner end being pivotally connected with the desk, the return comprising a vertical face panel and a work surface mounted at a rear side of the face panel, the return being pivotal between a closed position, wherein the return work surface is concealed behind the face panel under the desk top, and an open position, wherein the face panel extends outwardly from the front of the desk, adjacent a side of the kneehole opening in the desk, the face panel being configured so as to create an impression that the furniture unit is a credenza with no kneehole opening when the return is closed;

a pivot member interposed between the desk and the return, whereby the return is pivotally connected with the desk, the pivot member being positioned forward of the back of the desk; and a storage space defined adjacent one of the two opposing side panels, at least a portion of the storage space extending rearward of the pivot member, the storage space being independent of the return, whereby the storage space does not pivot between the closed and open positions with the return, further the return work surface being interposed between the desk top and the storage space when the return is in the closed position.

2. A furniture unit as in claim 1 wherein the desk includes a column of exposed storage location adjacent the kneehole opening opposite from the side on which the return extends in the open position, the front panel extending across the kneehole opening and up to the exposed storage location when the return is closed.

3. A furniture unit as in claim 2 wherein the exposed storage locations comprise drawers having drawer fronts, and the face panel has a facade that has an appearance of at least one or more drawer fronts or doors leading to internal storage locations, such that the front of the desk belies the presence of a desk having a kneehole opening when the face panel is closed.

4. A furniture unit as in claim 3 wherein the face panel facade extends from a first of the two opposing ends of the desk toward the other end, to the exposed storage locations and comprise first and second portions, the first portion having a plurality of simulated drawer fronts adjacent the first of the two opposing ends of the desk, the simulated drawer fronts in the face panel complementing real drawer fronts on the exposed storage location in the desk, the second portion covering the kneehole opening in the desk, the second portion including at least one simulated door front.

5. A furniture unit as in claim 1 wherein the desk includes a retracting keyboard tray and a mounting mechanism that mounts the keyboard tray in the kneehole opening under the desk top, and wherein the keyboard tray and the mounting mechanism define a space above the keyboard tray and mounting mechanism and below the desk top, that the return work surface is received into when the return is in the closed position.

6. A furniture unit as in claim 1 wherein the desk includes an inner storage unit positioned under the desk top adjacent the side to which the return is pivotally attached, the inner storage unit being accessible from the front thereof, which is in turn accessible only when the return is opened.

7. A furniture unit as in claim 6 wherein a top portion of the inner storage unit is spaced below the desk top by a distance sufficient to permit the return work surface to be received between the inner storage unit and the desk top when the return is closed.

8. A furniture unit providing a combination credenza and desk, comprising:

stationary desk, the desk having a front, an opposing back, and two opposing ends, the desk having a desk top, the desk having first and second side panels that extend generally downward from the desk top toward a supporting floor, the first and second side panels being spaced apart from one another, whereby a kneehole opening is defined between the first and second side panels;

a moveable return, the return having opposing inner and outer ends, the inner end being pivotally connected with the desk, whereby the return is pivotal between a closed position, wherein the return work surface is concealed under the desk top, and an open position, wherein the return work surface extends outwardly from the front of the desk, to one side of the kneehole opening;

a pivot member interposed between the desk and the return, whereby the return is pivotally connected with the desk, the pivot member being positioned forward of the back of the desk; and a storage space defined adjacent one of the two opposing side panels, at least a portion of the storage space extending rearward of the pivot member, the storage space being independent of the return, whereby the storage space does not pivot between the closed and open positions with the return, further the return work surface being interposed between the desk top and the storage space when the return is in the closed position.

9. A furniture unit as in claim 8 wherein the desk includes a column of exposed storage locations adjacent the kneehole opening opposite from the side on which the return extends in the open position, the return work surface extending across the kneehole opening and tip to the exposed storage locations when the return is closed.

10. A furniture unit as in claim 8 wherein the return work surface is mounted with a generally horizontal position, an inner corner of the return work surface adjacent the kneehole opening in the desk being supported on a pivoting support member that is pivotally mounted to the desk at a level below the return work surface, the support member having an upwardly extending pin that fits in and is guided by a groove in an underside of the return work surface, the support member providing legless vertical support for the corner of the return work surface at all positions of outward pivotal movement of the return.

11. A furniture unit according to claim 8 and further comprising mounting means for supporting an inner corner of the return work surface adjacent the desk in a generally horizontal position as the return is pivoted between its closed and open positions, all without employing a floor engaging vertical support member that extends downwardly to the floor from an underside of the corner, the support means permitting a person using the desk to swivel on a chair between the desk top and return work surface without having knee contact with the corner support means.

12. A furniture unit as in claim 8 wherein the desk includes a retracting keyboard tray and a mounting mechanism that mounts the keyboard tray in the kneehole opening under the desk top, and wherein the keyboard tray and the mounting mechanism define a space above the keyboard tray and mounting mechanism and below the desk top, that the return work surface is received into when the return is in the closed position.

13. A furniture unit as in claim 8 wherein the storage space is an inner storage unit that is spaced from the desk top and thereby defines a slot that receives the return work surface when the return is in the closed position.

* * * * *